US011937670B2

(12) United States Patent
Einhorn

(10) Patent No.: US 11,937,670 B2
(45) Date of Patent: Mar. 26, 2024

(54) QUICK-RELEASE SYSTEM FOR A WATCH BRACELET

(71) Applicant: Glashuetter Uhrenbetrieb GmbH, Glashuette/Sachsen (DE)

(72) Inventor: Sebastian Einhorn, Dresden (DE)

(73) Assignee: Glashuetter Uhrenbetrieb GmbH, Glashuette/Sachsen (DE)

( * ) Notice: Subject to any disclaimer, the term of this patent is extended or adjusted under 35 U.S.C. 154(b) by 0 days.

(21) Appl. No.: 17/935,367

(22) Filed: Sep. 26, 2022

(65) Prior Publication Data

US 2023/0200499 A1 Jun. 29, 2023

(30) Foreign Application Priority Data

Dec. 28, 2021 (EP) ..... 21218008

(51) Int. Cl.
*A44C 5/10* (2006.01)
*A44C 5/14* (2006.01)
*A44C 5/20* (2006.01)

(52) U.S. Cl.
CPC ..... *A44C 5/105* (2013.01); *A44C 5/14* (2013.01); *A44C 5/2066* (2013.01)

(58) Field of Classification Search
CPC ..... A44C 5/14; A44C 5/105; A44C 5/2066; A44C 5/02; A44C 5/185; A44C 5/24; A44C 5/246; A44C 5/107
See application file for complete search history.

(56) References Cited

U.S. PATENT DOCUMENTS 5,689,859 A * 11/1997 Cuche ..... A44C 5/24 24/69 J
5,787,554 A * 8/1998 Hashimoto ..... A44C 5/2052 24/71 J (Continued)

FOREIGN PATENT DOCUMENTS

CN 106263316 A 1/2017
CN 109567329 A 4/2019

(Continued)

OTHER PUBLICATIONS

European Search Report dated Jun. 13, 2022 in European Application 21218008.7 Filed on Dec. 28, 2021 (with English Translation of Categories of Cited Documents), 3 pages.

(Continued)

*Primary Examiner* — Robert Sandy
*Assistant Examiner* — Louis A Mercado
(74) *Attorney, Agent, or Firm* — Oblon, McClelland, Maier & Neustadt, L.L.P.

(57) ABSTRACT

A quick release system for an interchangeable watch strap on a clasp, the quick release system including an end link for securing the watch strap on the clasp, the end link including a body and two lateral end piece placed on each side of the body, a first lateral end piece being in one piece with the body and a mobile end piece, able to slide away from the body, a first bar including a first end being fixed to the first lateral end piece and a second free end cooperating with a bore of the mobile end piece; a second bar extending from the first end piece, including a first end able to slide inside the first end piece, and a second end articulated to the mobile end piece; a retaining stem arranged coaxial and fixed to the second bar.

11 Claims, 4 Drawing Sheets

(56) References Cited

U.S. PATENT DOCUMENTS

| | | | | |
|---|---|---|---|---|
| 6,401,307 | B1 * | 6/2002 | Wild | A44C 5/246 24/71 J |
| 6,434,798 | B1 * | 8/2002 | Yamakawa | A44C 5/24 24/71 J |
| 6,792,652 | B2 * | 9/2004 | Ferrario | A44C 5/24 24/71 J |
| 7,695,187 | B2 * | 4/2010 | So | A44C 5/102 24/265 R |
| 7,946,103 | B2 * | 5/2011 | So | A44C 15/0025 63/4 |
| 9,173,460 | B2 * | 11/2015 | Kaltenrieder | A44C 5/24 |
| 10,595,597 | B2 * | 3/2020 | Catheline | G04B 31/00 |
| 11,089,849 | B2 * | 8/2021 | Granito | A44C 5/246 |
| 2006/0162132 | A1 | 7/2006 | Roy | |
| 2008/0245105 | A1 | 10/2008 | Elbe et al. | |

FOREIGN PATENT DOCUMENTS

| | | | |
|---|---|---|---|
| JP | 02-132411 | U | 11/1990 |
| JP | 2020-512891 | A | 4/2020 |

OTHER PUBLICATIONS

Japanese Office Action issued in Japanese Patent Application No. 2022-168130 dated Dec. 5, 2023, (w/ English translation).

* cited by examiner

QUICK-RELEASE SYSTEM FOR A WATCH BRACELET

CROSS-REFERENCE TO RELATED APPLICATION

This application claims priority to European Patent Application No. 21218008.7, filed on Dec. 28, 2021, the entire disclosure of which is hereby incorporated herein by reference.

FIELD OF THE INVENTION

The invention relates to a to a quick-release system for a watch strap on a watchcase, in particular a metallic watch strap, or leather or rubber for example.

BACKGROUND OF THE INVENTION

Quick release systems for watch straps have enjoyed increasing popularity in recent years.

They allow the wearer of the watch to change the strap on a watch easily and without tools. In addition to changing the strap on the watch head, the tool-free change of the strap on the clasp is also desirable. A quick-change system on this enables the customer to use different straps, for example made of leather, rubber or textile, with the same clasp. This is particularly, but not exclusively, of interest for the area of "Haute Horlogerie". In the "Haute Horlogerie" complex and expensive folding clasps are widely used, some of them made of precious metal. Interchangeability of the strap on the clasp is therefore of particular importance in this area.

A common system for changing a strap on a folding clasp comprises a spring bar that has a protruding pin. By pulling the pin with the fingernail, the pin if the spring bar is pulled out of the counterpart, which releases the band. However, this system can hardly meet the requirements of "Haute Horlogerie". Plus, the use of a spring bar limits the implementation of a locking system.

In contrast to this, the present invention aims at a system, which meets high demands in term of functionality and ease of use.

SUMMARY OF THE INVENTION

It is an object of the invention to overcome these drawbacks in proposing a quick-release system which is easy to use and in which the locking element is subjected to little stress and which offers a high level of security. An invisible fastening in the assembled state and a low height requirement are also to be made possible.

Hence, the invention relates to a quick release system for an interchangeable watch strap comprising:

an end link for securing the watch strap on the watch case or the clasp, the end link comprising a body and two lateral end piece place on each side of the body, a first lateral end piece being in one piece with the body and the second lateral end piece, called mobile end piece () , able to slide away from the body, a first bar extending from the first end piece, and comprising a first end being fixed to the first lateral end piece and a second free end cooperating with a bore of the mobile end piece;

a second bar extending from the first end piece, comprising a first end able to slide inside the first end piece, and a second end linked to a retaining stem arranged coaxial and fixed to the second bar, so that the mobile end piece is moveable parallel to a longitudinal axis of said retaining stem, and so that the mobile end piece can move from a locked position where the mobile end piece is held against the body, to an unlocked position where the mobile end piece is free, locking means to lock the mobile end piece on the body, said locking means comprising a push button sliding inside the movable end link, and a locking pin fixed to the body and cooperating with the push button to allow said mobile end piece to be locked to or to be unlocked from the body of the end link.

According to other features of the invention:

the locking pin comprises a head and a cylindrical body, the head being larger than the body and cooperating with a hole formed in the push button;

the push button slides inside the mobile end piece perpendicularly to the plane of the body;

the mobile end piece comprises at least one spring cooperating with the push button to maintain it in its locked position;

the mobile end piece comprises guiding means for the push button;

the first end of the second bar comprises a head and a body, the head having a diameter larger than the diameter of the body;

the head of the first end of the second bar is sliding into a through hole of the first lateral end piece, the through hole comprising a first portion of a diameter and a second portion of diameter, diameter being larger than diameter, and diameter being smaller than the diameter of the first portion and bigger than diameter of the second portion;

the locking pin is fixed on the body between the second free end of the first bar and the second end of the second bar;

the locking pin and the second free end of the first bar form one element;

the retaining stem is screwed on the second end of the second bar, the retaining stem and the second bar, and implicitly the mobile end piece, being able to rotate in relation to the body.

Thus, the invention offers a high level of operating comfort and can meet the requirements of demanding customers. The presented system can be used with different folding clasps, and it is conceivable to replace the connection element for the strap in an existing folding clasp with the present invention. An existing folding clasp can be converted into a folding clasp with a quick-change system with little effort.

Another advantage of the invention is that no mechanisms are necessary in the strap itself. Since straps, in particular made of leather, are wearing parts which should be changed at regular intervals for hygienic and aesthetic reasons, it is desirable to make them as simple as possible. This reduces the manufacturing effort and thus also the price of the strap and increases flexibility.

BRIEF DESCRIPTION OF THE DRAWINGS

Other features and advantages of the present invention will appear more clearly upon reading the following detailed description, made with reference to the annexed drawings, given by way of non-limiting and in with.

DETAILED DESCRIPTION OF THE PREFERRED EMBODIMENTS

Figure 1B:
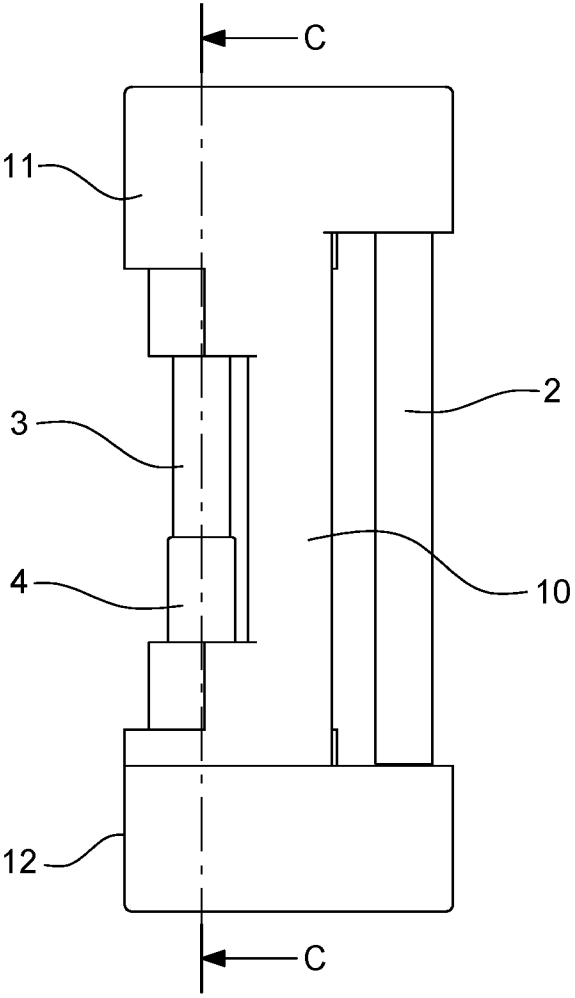
FIG. 1*b* is a view from the bottom of a quick-release system according to the invention.

The invention will now be described in detail with reference to the attached drawings illustrating, by way of example, an embodiment of the invention.

The invention proposes to give the user the possibility of easily and securely changing the wristband fitted to his/her watch while keeping the same clasp with the least possible handling, and also proposes a watch with interchangeable wristband for the lowest possible differential production cost.

It must be possible to change the wristband without any tool and without delicate handling while allowing a fast change between a leather wristband and a linked metal wristband, for example, or also allowing the wristband to be matched to items of clothing and/or jewellery worn by the user or to the complexion of the user, in accordance with the circumstances of use of the watch. The interchangeable wristband also enables wristbands of different length to be exchanged instantaneously, which allows retailers and dealers to immediately supply their customers with perfectly suited watches.

The invention thus preferably relates to a quick release system for an interchangeable watch strap 100 on a clasp 1000.

According to the invention, the quick release system comprises:

- an end link 1 for securing the watch strap 100 on the clasp 1000, the end link comprising a body 10 and two lateral end piece placed on each side of the body 10, a first lateral end piece 11 being in one piece with the body 10 and the second lateral end piece, called mobile end piece 12, able to slide away from the body 10,
- a first bar 2 extending from the first end piece 11, and comprising a first end 20 being fixed to the first lateral end piece 11 and a second free end 21 cooperating with a bore 13 of the mobile end piece 12;
- a second bar 3 extending from the first end piece 11, comprising a first end 30 able to slide inside the first end piece 11, and a second end articulated to the mobile end piece 12;
- a retaining stem 4 arranged coaxial and fixed to the second bar 3, so that the mobile end piece 12 is moveable parallel to a longitudinal axis of said retaining stem 4, and so that the mobile end piece 12 can be moved from a locked position where the mobile end piece 12 is held against the body 10, to an unlocked position where the mobile end piece 12 is free,
- locking means to lock the mobile end piece 12 on the body 10, said locking means comprising a push button 6 sliding inside the movable end link 12, and a locking pin 7 fixed to the body 10 and cooperating with the push button 6 to allow said mobile end piece 12 to be locked to or to be unlocked from the body 10 of the end link 1.

Advantageously, the first lateral end piece 11 has a milling contour that is complementary to the connector of the clasp 1000. Such assembly limits the movement of the first lateral end piece 11 in the plane of the end link. By plane of the end link, we consider a plane extending longitudinally along the end link 1.

Figure 1A:
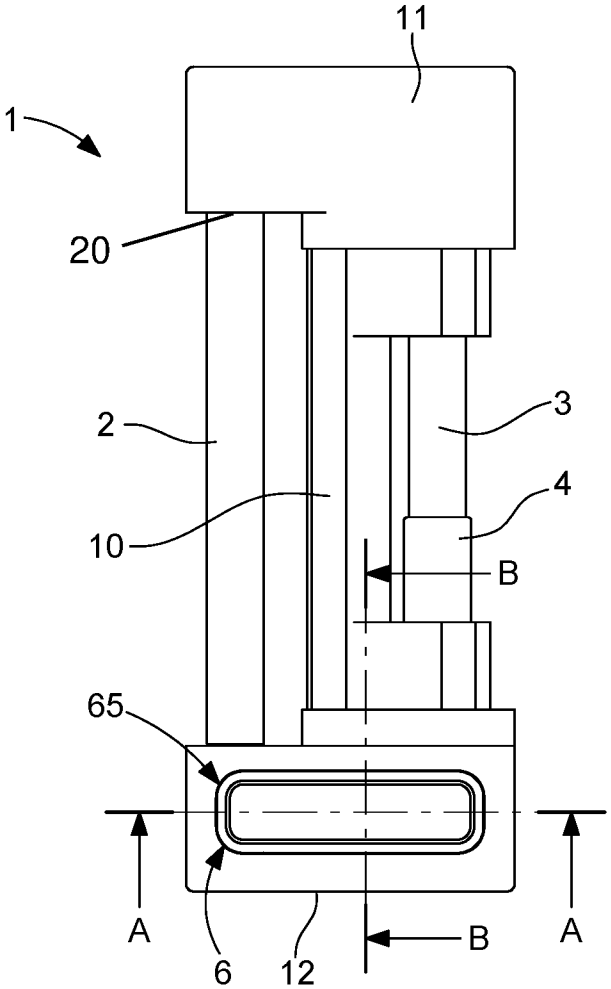
FIG. 1*a* is a view from the top of a quick-release system according to the invention.

As shown on FIGS. 1 and 2, the first lateral end piece 11 comprises an first bar 2, which is arranged to be connected to the strap 100.

The mobile end piece 12 comprises a complementary bore to receive the free end 21 of the first bar 2. The length of the first bar 2 is dimensioned so that the free end 21 is released when the mobile end piece 12 is pulled away from the body 10 in its unlocked position, thus enabling the mobile end piece 12 to rotate and enabling the user to remove the strap. In locked position, the free end 21 of the first bar 2 is fitted into the bore 13 and prevent the mobile end piece 12 from rotating around the retaining stem 4.

The first lateral end piece 11 is connected radially to the clasp 1000 by the second bar 3. This second bar 3, designed as a screw in the variant shown on figures, can move in an axial direction parallel to a longitudinal axis of said second bar 3, within the first lateral end piece 11.

The first end 30 of the second bar 3 comprises a head 32 and a body 33, the head 32 having a diameter D1 larger than the diameter D2 of the body 33 of the second bar 3.

Figure 2A:
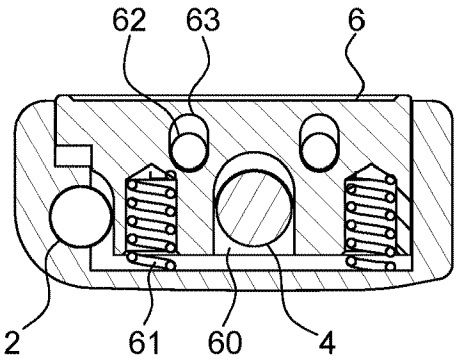
FIGS. 2*a* and 2*b* are cross-section views of a quick-release system according to the invention.
Figure 2B:
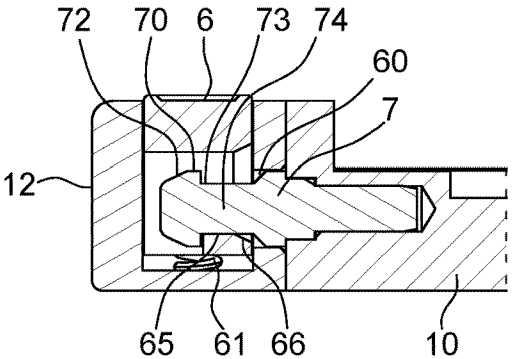
Figure 2C:
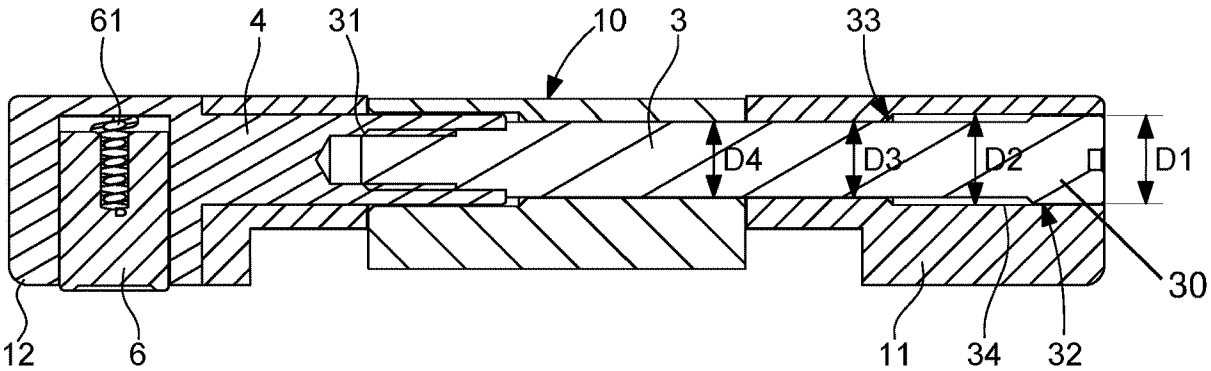
FIG. 2*c* is another cross-section view of a quick-release system according to the invention.
Figure 2D:
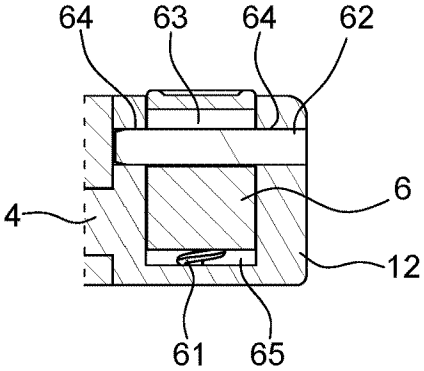
FIG. 2*d* is another cross-section view of a quick-release system according to the invention.

As can be seen on FIG. 2*c*, the first lateral end piece 11 comprises a stepped bore 34 which goes through it and provides a stop for the first end of the second bar 3. The head 32 of the first end 30 of the second bar 3 is sliding into the stepped bore 34 of the first lateral end piece 11, the stepped bore 34 comprising a first portion of a diameter D3 and a second portion of diameter D4. The diameter D3 of the first portion is larger than diameter D4, and the diameter D1 of the head 32 is slightly smaller than the diameter D3 of the first portion of the stepped bore 34 and slightly bigger than diameter D4 of the second portion of the stepped bore 34, so that the second bar 3 can slide inside the stepped bore 34 and be stopped by the stepped bore 34.

Advantageously, the length of the stepped bore 34 determines the stroke of the first end of the second bar 3 inside the stepped bore 34.

According to the invention, the mobile end piece 12 is firmly connected to the second bar 3 via its second end 31 to the retaining stem 4. In the variant shown, the retaining stem 4 is fixed to the second end 31 of the second bar 3 by means of a thread. However, other types of connection are also conceivable, for example a press connection. Thanks to this arrangement, the retaining stem 4 and the second bar 3, and implicitly the mobile end piece 12, are able to rotate in relation to the body 10 around the axis of the second bar 3. Such an arrangement simplifies the maintenance operation when needed too, the operator only need to unscrew the mobile end piece from the second bar 3.

Thanks to this arrangement, the mobile end piece 12 is limited in an axial direction parallel to a longitudinal axis of said second bar 3 or retaining stem 4 (which is the same) by the first end piece 11, which at the same time limits the axial displacement of the second bar 3 in this direction. As a result, the mobile end piece 12 can only move in an axial direction parallel to a longitudinal axis of said second bar 3.

The mobile end piece 12 can also be rotated around the longitudinal axis of the second bar 3.

The quick release system also comprises locking means formed by a locking pin 7 that is firmly connected to it and a push button 6. The locking pin 7 comprises a head 70 and a cylindrical body 71, the head 70 being larger than the body 71 and cooperating with a hole 60 formed in the push button. As shown on the figures, the locking pin 7 has a mushroom shape, the head comprising a slope 72 and the body comprising a groove 73.

According to the invention, the locking pin 7 is fixed on the body 10 between the second free end 21 of the first bar 2 and the second end 31 of the second bar 3.

It is also possible to merge the locking pin 7 and the second free end 21 of the first bar 2 so it forms one and same element. Such an arrangement would be an easy task for a man skilled in the art and is not shown on the figures.

The push button 6 also has a slope 66 located just before the hole 60, the hole 60 and the slope 66 being arranged to cooperate with the slope 72 of the locking pin 7 to ease the lock of the mobile end piece 12 onto the body 10.

The mobile end piece 12 has a milling 65 in which the push button 6 is located. The push button 6 can move in a direction perpendicular to the plane of the end link 1 within this milling 65. The mobile end piece 12 comprises at least one spring 61, and preferably two springs 61, cooperating with the push button 6 to maintain it in its locked position. The two springs 6 are located on each side of the push button 6.

As shown on FIG. 2*a*, the mobile end piece 12 also comprises guiding means for the push button. The guiding means are formed by the mean of through holes 64 in the mobile end piece 12, and into which two tenons 62 are inserted. Plus, the push button 6 has oblong holes 63 which, in conjunction with the two tenons 62, limit the stroke of the push button 6 and maintain it inside the milling of the mobile end piece 12.

Figure 3A:
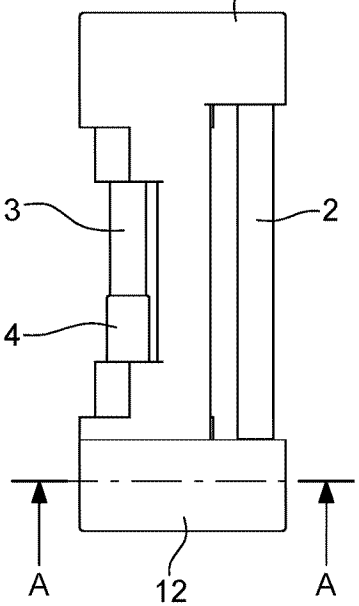
Figure 3B:
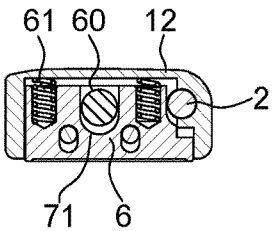
Figure 8:
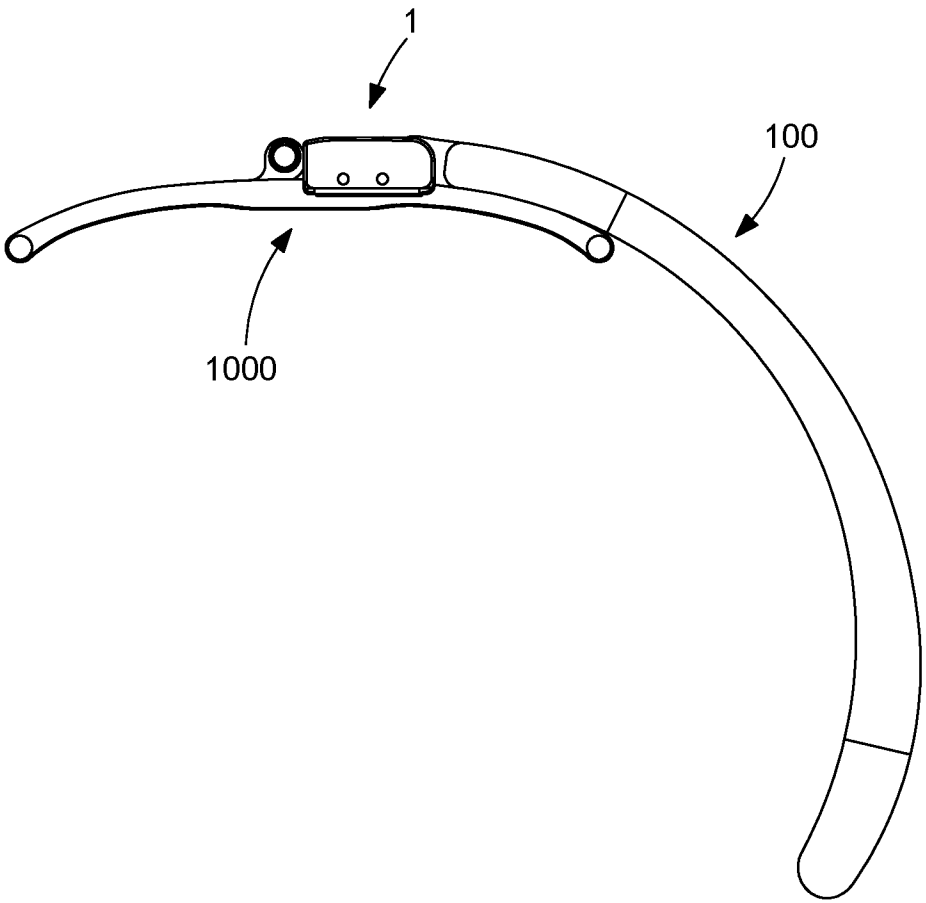
FIG. 8 is a side view of a clasp equipped with a quick-release system according to the invention.
Figure 7:
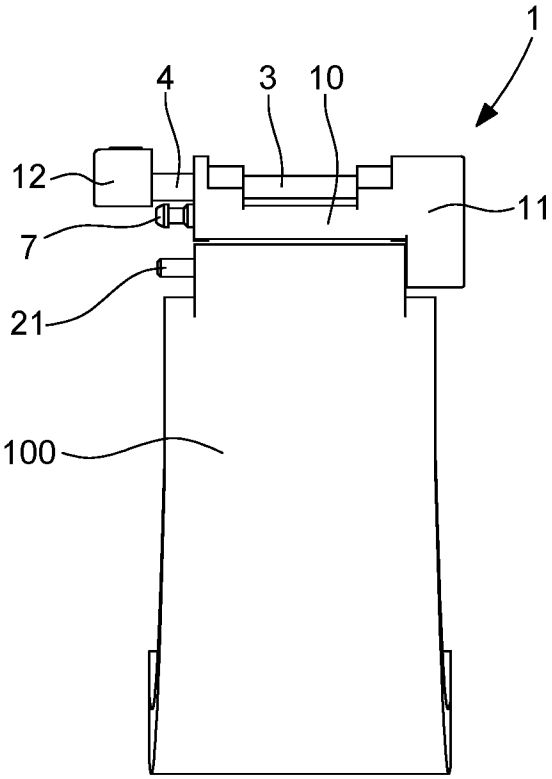
FIG. 7 is a view from the top of a strap equipped with a quick-release system according to the invention.

In the locked position, the push button 6 is locked into the groove 73 of the locking pin 7 as can be seen in FIG. 2*b* or FIG. 3*b*, which prevents the push button 6 from moving in the direction of the longitudinal axis of the second bar 3. Since the push button 6 is also limited by the milling 65 in the mobile end piece 12 in a direction perpendicular to the plane of the end link 1, the movement of the mobile end piece 12 in this direction is consequently also prevented.

Figure 5A:
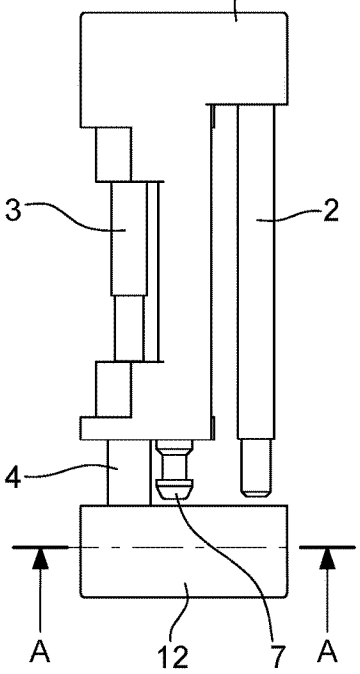
Figure 5B:
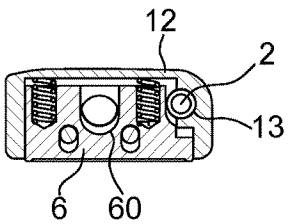
Figure 4A:
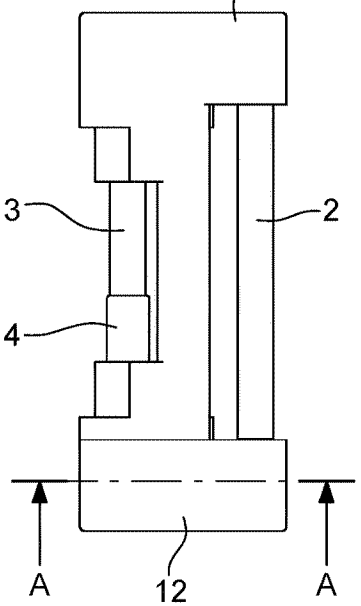
Figure 4B:
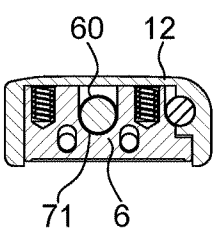

To unlock the mobile end piece 12, the push button is pressed perpendicularly to the plane of the end link 1 to the bottom of the milling 65 in the mobile end piece 12, the locking pin is released (FIG. 4*b*) and the mobile end piece 12 can be pulled in the longitudinal axis of the second bar 3 within its constraints (FIG. 5*a*).

Figure 6A:
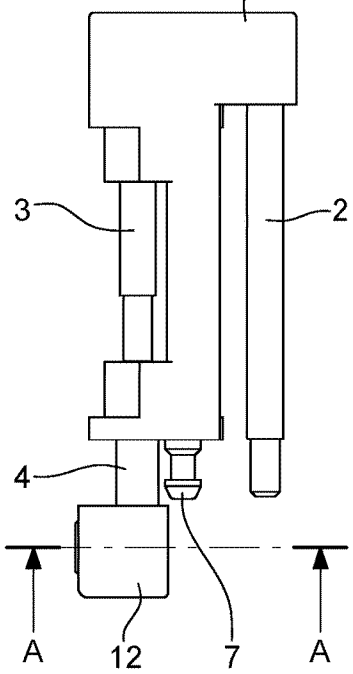
FIG. 3*a*, 3*b*, 4*a*, 4*b*, 5*a*, 5*b*, 6*a* 6*b* are respectively views from the top and cross-section views of the different steps to open a quick-release system according to the invention.
Figure 6B:
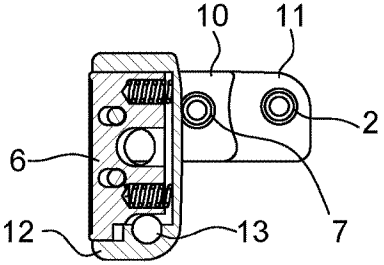

When the mobile end piece is fully extended, it can be swivelled around the longitudinal axis of the second bar 3. This releases first bar 2 and enables the strap to be exchanged (FIG. 6*a*-6*b*).

Then to lock the mobile end piece 12, the mobile end piece is rotated back until the first bar 2 is aligned with the hole 13 in the mobile end piece 12 again. After the alignment is done, the wearer pushes the mobile end piece 12 in the direction of the longitudinal axis of the second bar 3. After a short distance, the slope 72 of the locking pin 7 comes into contact with the slope 66 of the push button 6 so the slope 66 of the push button 6 slides over the slope 72 of the locking pin 7, causing the push button to move perpendicularly to the plane of the end link 1 inside the milling 65.

When the edge of the push button 6 finally slides over the edge of the locking pin 7, the push button 6 is pressed by the force of the springs 61 and thus engages in the groove 73 of the locking pin 7. The mechanism is now in its locked position again.

The invention also relates to a wristband 1100 comprising at least one end link 1 of a system according to the invention.

The invention also relates to a watch comprising at least one wristband equipped with an end link 1 of the system according to the invention.

The invention claimed is:

1. A quick release system for an interchangeable watch strap on a clasp, the quick release system comprising:

an end link for securing the watch strap on the clasp, the end link comprising a body and two lateral end piece placed on each side of the body, a first lateral end piece being in one piece with the body and a second lateral end piece, called mobile end piece, able to slide away from the body, a first bar extending from the first lateral end piece, and comprising a first end being fixed to the first lateral end piece and a second free end cooperating with a bore of the mobile end piece;

a second bar extending from the first lateral end piece, comprising a first end able to slide inside the first lateral end piece, and a second end articulated to the mobile end piece;

a retaining stem arranged coaxial and fixed to the second bar, so that the mobile end piece is moveable parallel to a longitudinal axis of said retaining stem, and so that the mobile end piece can be moved from a locked position where the mobile end piece is held against the body, to an unlocked position where the mobile end piece is free, locking means to lock the mobile end piece on the body, said locking means comprising a push button sliding inside the mobile end piece, and a locking pin fixed to the body and cooperating with the push button to allow said mobile end piece to be locked to or to be unlocked from the body of the end link.

2. The quick release system according to claim 1, wherein the locking pin comprises a head and a cylindrical body, the head being larger than the cylindrical body and cooperating with a hole formed in the push button.

3. The quick release system according to claim 1, wherein the push button slides inside the mobile end piece perpendicularly to a plane of the body.

4. The quick release system according to claim 1, wherein the mobile end piece comprises at least one spring cooperating with the push button to maintain the push button in its locked position.

5. The quick release system according to claim 1, wherein the mobile end piece comprises guiding means for the push button.

6. The quick release system according to claim 1, wherein the first end of the second bar comprises a head and a body, the head having a diameter (D1) larger than a diameter (D2) of the body.

7. The quick release system according to claim 6, wherein the head of the first end of the second bar is sliding into a stepped bore of the first lateral end piece, the stepped bore comprising a first portion of a diameter (D3) and a second portion of a diameter (D4), the diameter (D3) being larger than the diameter (D4), and the diameter (D1) being larger than the diameter (D3) of the first portion and bigger than the diameter (D4) of the second portion.

8. The quick release system according to claim 1, wherein the locking pin is fixed on the body between the second free end of the first bar and the second end of the second bar.

9. The quick release system according to claim 1, wherein the locking pin and the second free end of the first bar form one element.

10. The quick release system according to claim 1, wherein the retaining stem is screwed on the second end of the second bar, the retaining stem and the second bar, and implicitly the mobile end piece, being able to rotate in relation to the body.

11. A watch strap comprising at least one end link of a device according to claim 1.

* * * * *